US010920165B2

(12) United States Patent
Tazaki et al.

(10) Patent No.: US 10,920,165 B2
(45) **Date of Patent: *Feb. 16, 2021**

(54) LUBRICATING OIL COMPOSITION FOR HYDRAULIC ACTUATOR EQUIPPED WITH ELECTRONIC CONTROL DEVICE

(71) Applicant: SHELL OIL COMPANY, Houston, TX (US)

(72) Inventors: Hiroyuki Tazaki, Aikou (JP); Hiroshi Kaneko, Minato-ku (JP); Mitsuhiro Nagakari, Tokyo (JP); Mai Kitagawa, Minato-ku (JP)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/473,683

(22) PCT Filed: Dec. 21, 2017

(86) PCT No.: PCT/EP2017/084129

§ 371 (c)(1),
(2) Date: Jun. 26, 2019

(87) PCT Pub. No.: WO2018/122102

PCT Pub. Date: Jul. 5, 2018

(65) Prior Publication Data

US 2019/0316059 A1 Oct. 17, 2019

(30) Foreign Application Priority Data

Dec. 28, 2016 (JP) ..... 2016-255016

(51) Int. Cl.

| | |
|---|---|
| ***C10M 165/00*** | (2006.01) |
| *C10N 10/04* | (2006.01) |
| *C10N 20/04* | (2006.01) |
| *C10N 30/02* | (2006.01) |
| *C10N 30/06* | (2006.01) |
| *C10N 30/08* | (2006.01) |
| *C10N 30/00* | (2006.01) |
| *C10N 40/08* | (2006.01) |

(52) U.S. Cl.

CPC ..... *C10M 165/00* (2013.01); *C10M 2201/08* (2013.01); *C10M 2203/1006* (2013.01); *C10M 2207/262* (2013.01); *C10M 2209/084* (2013.01); *C10N 2010/04* (2013.01); *C10N 2020/04* (2013.01); *C10N 2030/02* (2013.01); *C10N 2030/06* (2013.01); *C10N 2030/08* (2013.01); *C10N 2030/76* (2020.05); *C10N 2040/08* (2013.01)

(58) Field of Classification Search

CPC ..... C10M 165/00; C10M 2201/08; C10M 2203/1006

See application file for complete search history.

(56) References Cited

U.S. PATENT DOCUMENTS

| | | | | |
|---|---|---|---|---|
| 10,597,600 | B2 * | 3/2020 | Nagakari | C10M 101/02 |
| 2008/0234155 | A1 * | 9/2008 | Wardlow | C10M 169/04 508/390 |
| 2008/0255011 | A1 * | 10/2008 | Poirier | C10M 169/04 508/463 |
| 2018/0119050 | A1 * | 5/2018 | Gibson | C10M 171/02 |

FOREIGN PATENT DOCUMENTS

| | | | | |
|---|---|---|---|---|
| EP | 2650348 | A1 | 10/2013 | |
| EP | 3140378 | A1 * | 3/2017 | C10M 129/56 |
| GB | 2105365 | A | 3/1983 | |
| JP | 2001234187 | A | 8/2001 | |
| WO | 2017162774 | A1 | 9/2017 | |

OTHER PUBLICATIONS

International Search Report and Written Opinion received for PCT Patent Application No. PCT/EP2017/084129 dated Mar. 29, 2018, 09 pages.

"Flow Electrification of a Liquid in Narrow Pipes", Bulletin of the Aichi Institute of Technology, Mar. 31, 1979.

* cited by examiner

*Primary Examiner* — Ellen M McAvoy
*Assistant Examiner* — Ming Cheung Po

(57) ABSTRACT

An object of the present invention is to provide a lubricating oil composition for hydraulic actuation which has excellent safety and which is imparted with electrical conductivity in order to prevent the generation of noise that adversely affects devices including hydraulic circuits equipped with an electronic control device for the valve system. The composition uses a hydrocarbon base oil, and the base oil contains from 30 to 250 ppm of ultrabasic magnesium salicylate in terms of magnesium content relative to the total amount of the composition, and from 0.07 to 5.0 mass % of non-dispersible polymethacrylate having a weight-average molecular weight of from 5,000 to 200,000 as a net amount relative to the total amount of the composition. The conductivity of the composition at 25° C. is 200 pS/m or more, the flash point is 240° C. or more, the pour point is negative 40° C. or less, and the coefficient of friction at 140° C. by a microclutch is 0.08 or more. This lubricating oil composition can be imparted with conductivity in order to prevent the generation of noise that adversely affects electronic controls when used in machinery equipped with electronic control devices.

4 Claims, No Drawings

LUBRICATING OIL COMPOSITION FOR HYDRAULIC ACTUATOR EQUIPPED WITH ELECTRONIC CONTROL DEVICE

CROSS REFERENCE TO EARLIER APPLICATION

The present application is the National Stage (§ 371) of International Application No. PCT/EP2017/084129, filed Dec. 21, 2017, which claims priority from JP Application 2016-255016, filed Dec. 28, 2016 incorporated herein by reference.

FIELD OF THE INVENTION

The present invention relates to a lubricating oil composition for hydraulic machinery which is conductive in order to prevent the malfunction or failure of electronic control devices such as an electronic control valve system.

BACKGROUND OF THE INVENTION

Oils such as general lubricating oils are liquids with good insulating properties whose main component is a hydrocarbon. It has been known for a long time that, when these liquids are transported through pipes, static electricity is generated (known as "flow electrification") as described in JP2001234187

The electric charge generated at this time is transferred to the storage tank along with the liquid. Sometimes sparks generated by charges and discharges in and around the tank ignite the liquid. In order to reduce static buildup and prevent sparks, additives such as STADIS-450 (from DuPont) containing dinonylnaphthylsulfonic acid as an active component are included to raise electric conductivity (conductivity, conductance).

In addition, the transport of oil at higher speeds enabled by the improved performance of hydraulic equipment in recent years has increased the risk of static electricity being generated. Sparks generated by electrical phenomena occurring at the interface between a solid such as a storage tank and oil also become noise that causes control devices containing electronic components to malfunction or fail.

Hydraulic oil is a power-transmitting fluid used in operations such as power transmission, power control, and buffering in hydraulic systems such as hydraulic devices and equipment, and also lubricates sliding parts.

As hydraulic devices have become smaller and more powerful, operating pressures have increased from a conventional value of 14-20 MPa to a more recent value of 30 MPa or more. This combined with higher oil transport speeds, has further raised the possibility that flow electrification will occur. Because these hydraulic systems are usually equipped with an electronic control valve system, countermeasures to prevent the generation of spark noise and oils with a high flash point are desired from the standpoint of storage safety. Also, when used for lubrication of wet brakes, an oil must have a suitable coefficient of friction to prevent braking problems.

In order to improve the conductivity of lubricating oil compositions, a product has been proposed in which a base oil contains a combination of an aromatic azo compound and material with a strong polar group and a lipophilic group of an appropriate size in the molecule, such as an organometallic compound, a succinic acid derivative, or an amine derivative. An acceptable value for the volume resistivity of this product is $1\times10^{10}$ Ω·cm or less, which is equivalent to 10 pS/m or more when expressed in siemens (S). This value is insufficient for reliably preventing the generation of sparks due to flow electrification. In addition, the lubricating oil has a red color because it contains an aromatic azo compound as an essential component, and this makes it difficult to determine by on-site visual inspection whether the lubricating oil has deteriorated. This lubricating oil also does not take braking characteristics into account, see Bulletin of the Aichi Institute of Technology, B-14, 1-6, "Flow Electrification of a Liquid in Narrow Pipes," Mar. 31, 1979.

An object of the present invention is to provide a lubricating oil composition for hydraulic machinery which has excellent safety, which is imparted with electrical conductivity in order to prevent the generation of noise that adversely affects electronic control devices used to control valve systems, and which has excellent braking characteristics when used with electronically controlled wet brakes.

SUMMARY OF THE INVENTION

The present invention is a composition using a hydrocarbon base oil, the base oil containing from 30 to 250 ppm of ultrabasic magnesium salicylate in terms of magnesium content relative to the total amount of the composition, and from 0.07 to 5.0 mass % of non-dispersible polymethacrylate having a weight-average molecular weight of from 5,000 to 200,000 as a net amount relative to the total amount of the composition.

The present invention is a lubricating oil composition for hydraulic machinery equipped with an electronic control device in which the conductivity of the composition at 25° C. is 200 pS/m or more (where S is siemens), the flash point is 240° C. or more, the pour point is −40° C. or less, and the coefficient of friction by a microclutch at 140° C. is 0.08 or more.

The hydrocarbon base oil may comprise a gas-to-liquid (GTL) base oil, and preferably comprises at least 40 mass % of a gas-to-liquid base oil.

The kinetic viscosity of the lubricating oil composition at 40° C. may be from 10 to 100 $mm^2/s$.

DETAILED DESCRIPTION OF THE INVENTION

A lubricating oil composition of the present invention can increase electrical conductivity, has a low pour point, experiences very little flow electrification, and can prevent the generation of sparks due to an electrostatic charge. It also has a high flash point and can be safely used. It can be used as a lubricating oil composition for hydraulic machinery to prevent the generation of noise that adversely affects devices, including hydraulic circuits equipped with an electronic control device for the valve system, and has excellent braking characteristics when used with electronically controlled wet brakes.

In the present invention, a hydrocarbon base oil is used as the base oil. This hydrocarbon base oil can be any base oil belonging to Group 1, Group 2, Group 3, Group 4, or Group 5 of the API (American Petroleum Institute) base oil categories, such as naphthenic oils, and can be used alone or in mixtures thereof.

Group 1 base oils include paraffinic mineral oils obtained by an appropriate combination of refining methods such as solvent refining, hydrorefining, and dewaxing performed on lubricating oil fractions obtained from atmospheric distillation of crude oil.

The Group 1 base oils used herein have a 100° C. kinetic viscosity (in accordance with ASTM D445 and JIS K2283, same below) from 2 to 15 $mm^2/s$, preferably from 4 to 15 $mm^2/s$, and more preferably from 6 to 11 $mm^2/s$, and have a viscosity index (in accordance with ASTM D2270 and JIS K2283, same below) from 90 to 120, preferably from 95 to 120, and more preferably from 95 to 110. The sulfur content is from 0.03 to 0.7 mass %, preferably from 0.3 to 0.7 mass %, and more preferably from 0.4 to 0.7 mass %. The % CA in accordance with ASTM D3238 is 5 or lower, preferably 4 or lower, and more preferably 3.4 or lower, and the % CP is 60 or higher, more preferably 63 or higher, and more preferably 66 or higher.

Group 2 base oils include paraffinic mineral oils obtained by an appropriate combination of refining methods such as hydrorefining and dewaxing performed on lubricating oil fractions obtained from atmospheric distillation of crude oil. Group 2 base oils refined using, for example, the Gulf Oil hydrorefining method have a total sulfur content of less than 10 ppm and an aromatic content of 5% or less. Use of these base oils is preferred in the present invention. There are no particular restrictions on the viscosity of the base oil and the viscosity index may be from 100 to 120. The kinetic viscosity at 100° C. is from 2 to 15 $mm^2/s$, preferably from 4 to 15 $mm^2/s$, and more preferably from 6 to 11 $mm^2/s$. The total sulfur content is less than 0.03 mass % (300 ppm), preferably less than 0.02 mass % (200 ppm), and more preferably less than 0.001 mass % (10 ppm). The total nitrogen content is less than 10 ppm and preferably less than 1 ppm. The aniline point (as measured in accordance with ASTM D611 and JIS K2256) is from 80 to 150° C. and preferably from 100 to 135° C.

The base oil is preferably a paraffinic mineral oil produced by a high degree of hydrorefining performed on lubricating oil fractions obtained from the atmospheric distillation of crude oil, a base oil refined using the Isodewax process which dewaxes and substitutes the wax produced by the dewaxing process with isoparaffins, or a base oil refined using the Mobil Oil wax isomerization process. These base oils correspond to API Group 2 or Group 3 base oils. There are no particular restrictions on the viscosity, but the viscosity index may be from 100 to 160, preferably from 100 to 145. The kinetic viscosity at 100° C. is from 2 to 15 $mm^2/s$, preferably from 4 to 15 $mm^2/s$, and more preferably from 6 to 11 $mm^2/s$. The total sulfur content is from 0 to 0.03 mass % (0 to 300 ppm), and preferably less than 0.01 mass % (100 ppm). The total nitrogen content is less than 10 ppm and preferably less than 1 ppm. The aniline point is from 80 to 150° C. and preferably from 100 to 135° C.

GTL (gas-to-liquid) oils synthesized using the Fischer-Tropsch method of converting natural gas to liquid fuel have a very low sulfur content and aromatic content compared to mineral-oil base oils refined from crude oil, and also have a very high paraffin ratio. As a result, they have excellent oxidative stability. Because they also experience extremely low evaporation loss, use of these base oils is also preferred in the present invention. There are no particular restrictions on the viscosity of the GTL base oil, but the viscosity index is usually from 100 to 180, and preferably from 100 to 150. The kinetic viscosity at 100° C. is from 2 to 12 $mm^2/s$, and preferably from 2 to 9 $mm^2/s$. The total sulfur content is usually less than 0.03 mass % (300 ppm) and preferably less than 10 ppm. The total nitrogen content is less than 1 ppm. These GTL base oils correspond to API Group 3 base oils, and Shell XHVI (registered trademark) is an example of a commercial product.

Some or all of the base oil can be composed of a GTL oil. When some is used, the performance of the lubricating oil composition is further improved when the amount is 30 mass % or more, preferably 40 mass % or more, and more preferably 50 mass % or more.

Examples of hydrocarbon synthetic oils include polyolefins having a kinetic viscosity at 100° C. from 2 to 12 $mm^2/s$ and oligomers of ethylene and alpha olefins (Group 4) as well as alkyl benzenes, alkyl naphthalenes, and alkyl diphenyl alkanes (Group 5). Mixtures of these can also be used.

These olefins include polymers of various types of olefin and hydrides thereof. Any olefin can be used. Examples include ethylene, propylene, butene, and α-olefins having five or more carbon atoms. When manufacturing polyolefins, these olefins can be used alone or in combinations of two or more.

Polybutenes and polyolefins known as polyalphaolefins (PAO) with a kinetic viscosity at 100° C. of from 2 to 12 $mm^2/s$ are preferred. These are base oils belonging to Group 4. A polyalphaolefin may be mixed with two or more synthetic oils.

Group 5 base oils are synthetic base oils such as oxygen-containing ester and ether base oils. Because these base oils have a high density, they cause the absolute viscosity to rise when used as a lubricating oil composition and cause pressure loss when used as a hydraulic oil. Therefore, from the standpoint of energy saving, use of the oxygen-containing base oils in Group 5 should be avoided as base oils in the present invention.

Among these hydrocarbon base oils, base oils having a kinetic viscosity at 100° C. of 2 $mm^2/s$ have a low molecular weight. Therefore, the flash point of the base oils (as measured in accordance with the COC method of JIS K2265-4) is usually a low 150° C. or less. Also, the NOACK (as measured in accordance with ASTM D5800) is high and evaporation loss is greater. Therefore, these base oils are not suitable for long-term lubrication of bearings and hydraulic machinery. When the kinetic viscosity at 100° C. is 15 $mm^2/s$ or higher, the low-temperature viscosity of the lubricating oil composition (as measured in accordance with ASTM D5293 and ASTM D4684) is higher. As a result, these base oils are not suitable for use as a bearing and hydraulic oil at high rotational speeds.

When the % CA is greater than 5 or the % CP is less than 60, the solubility and polarity of the base oil improve. However, thermal and oxidative stability decline. When the sulfur content is greater than 0.7 mass %, the thermal and oxidative stability of the final bearing oil or hydraulic oil declines, and undesirable phenomena such as corrosion of non-ferrous metals such as copper and aluminum alloys occurs.

The base oil content of the lubricating oil composition in terms of the overall mass of the lubricating oil composition is from 50 to 99 mass %, preferably from 60 to 99 mass %, and more preferably from 70 to 99 mass %.

Ultrabasic metal salicylates are added to the base oil. Ultrabasic metal salicylates are well-known metallic detergents, and the elemental metal content in terms of the weight ratio is 1% or more, preferably 10% or less, and more preferably 8% or less.

The metals in these ultrabasic metal salicylates are alkali metals such as sodium or potassium and alkaline-earth metals such as calcium and magnesium. Among these, magnesium is preferred. Magnesium can be combined with calcium in some situations.

The magnesium content of an ultrabasic metal salicylate relative to the overall mass of the composition is preferably 30 ppm or greater, more preferably 50 ppm or greater, and even more preferably 70 ppm or greater. The upper limit is preferably 250 ppm or less, more preferably 200 ppm or less, and even more preferably 150 ppm or less. When magnesium and calcium are combined, the total amount of magnesium and calcium relative to the overall mass of the composition is preferably 30 ppm or more. The upper limit is preferably 300 ppm or less. When the content is less than 30 ppm, the required electrical conductivity is sometimes not obtained. When the content exceeds 300 ppm, the friction coefficient characteristics decline and braking problems occur if used with wet brakes.

There are no particular restrictions on the structure of the ultrabasic metal salicylate. However, use of a metal salt of a salicylic acid having an alkyl group with 1 to 30 carbon atoms is preferred. An alkyl group with 10 to 25 carbon atoms is preferred and an alkyl group with 10 to 20 carbon atoms is especially preferred from the standpoint of improving conductivity and the friction coefficient.

In a ultrabasic salt, the base number of the metal salicylate is 150 mgKOH/g or higher. The base number is measured in accordance with the potentiometric titration method in section 7 of JIS K2501 (Petroleum Products and Lubricants—Determination of Neutralization Number).

Poly(meth)acrylates are added to the base oil. Poly(meth) acrylates are well-known viscosity index improvers. Examples include so-called non-dispersible poly(meth)acrylates which are polymers or copolymers of one or more monomers selected from among various types of (meth) acrylic acid esters, as well as hydrogenated products thereof.

Shear stability is taken into account when selecting the molecular weight of the poly(meth)acrylate. Specifically, the weight-average molecular weight of a non-dispersible poly (meth)acrylate is usually from 5,000 to 200,000, preferably from 8,000 to 100,000, and more preferably from 10,000 to 50,000. In the poly(meth)acrylate, the molecular weight of the one or more monomers may be different and can be included in any amount.

Examples of non-dispersible poly(meth)acrylates include polymers or copolymers of one or more monomer selected from among the compounds expressed by Formula (1) below, as well as hydrogenated products thereof.

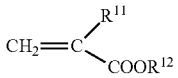

(1)

In Formula (1), $R^{11}$ represents a hydrogen atom or a methyl group, and $R^{12}$ represents an alkyl group having from 1 to 18 carbon atoms. The alkyl groups having from 1 to 18 carbon atoms that are represented by $R^{12}$ include a methyl group, ethyl group, propyl group, butyl group, pentyl group, hexyl group, heptyl group, octyl group, nonyl group, decyl group, undecyl group, dodecyl group, tridecyl group, tetradecyl group, pentadecyl group, hexadecyl group, heptadecyl group, and octadecyl group. These alkyl groups may be linear or branched.

Preferred examples of monomer components in Formula (1) include alkyl acrylates having from 1 to 18 carbon atoms, alkyl methacrylates having from 1 to 18 carbon atoms, olefins having from 2 to 20 carbon atoms, styrene, methyl styrene, maleic anhydride esters, and mixtures thereof.

The poly(meth)acrylate is usually diluted and provided in the form of a solution. In this state, the content in the lubricating oil composition relative to the overall mass of the composition is usually 0.1 mass % or more. The upper limit is 10 mass % or less, preferably 8 mass % or less, and more preferably 5 mass % or less. When the content relative to the overall mass of the composition is 0.1 mass % or less, improved conductivity is difficult to obtain. When the content exceeds 10 mass %, the shear stability may deteriorate.

The content in terms of the net amount of poly(meth) acrylate is from 0.07 to 5.0 mass %.

A phosphorus compound can be added to the lubricating oil composition to further improve wear resistance. Examples of phosphorus compounds include zinc dithiophosphate and zinc phosphate. These phosphorus compounds are blended at 0.01 to 0.10 mass % (100 to 1,000 ppm) per 100 parts by mass base oil. The amount of phosphorus relative to the overall mass of the lubricating oil is preferably from 0.01% (100 ppm) to 0.08% (800 ppm) and more preferably from 0.01 to 0.04 mass %. These phosphorus compounds can be used alone or in combinations of more than one.

If necessary, other types of additives can be used in a lubricating oil composition of the present invention to improve performance. Examples of additives include ashless friction modifiers (such as monoglycerides), pour point depressants, antioxidants, extreme pressure agents, oiliness improvers, metal deactivators, antiwear agents, antifoaming agents, viscosity index improvers, detergents, rust inhibitors, and antifoaming agents. Any other lubricating oil additive common in the art can be used.

The conductivity (conductance) at 25° C. (room temperature) of a lubricating oil composition of the present invention is at least 200 pS/m. When less than 200 pS/m, the ability to ground the buildup of static electricity generated by flow electrification is reduced and trouble caused by static electricity cannot be effectively prevented. Because the flash point of a lubricating oil composition of the present invention is 240° C. or higher, and preferably 250° C. or higher, it can be safely handled as a flammable liquid under the Fire Service Act. Because the pour point is −40° C. or less, it can sufficiently withstand use in cold climates.

There are no particular restrictions on the viscosity of the lubricating oil composition. However, the kinetic viscosity at 100° C. is from 2 to 15 $mm^2/s$, preferably from 4 to 15 $mm^2/s$, and more preferably from 6 to 11 $mm^2/s$. The kinetic viscosity at 40° C. is from 10 to 100 $mm^2/s$, preferably from 15 to 100 $mm^2/s$, more preferably from 22 to 100 $mm^2/s$, and even more preferably from 41 to 75 $mm^2/s$.

The viscosity grade of the lubricating oil composition is VG 46 to VG 68 which is especially favorable for use as a hydraulic oil.

EXAMPLES

The following is a more detailed description of the present invention with reference to examples and comparative examples. However, the present invention is not restricted to these examples.

The following materials were prepared for the production of the examples and the comparative examples.

Base Oil 1: A hydrocarbon base oil blend consisting of 50 mass % GTL (kinetic viscosity at 40° C. of 44.0 $mm^2/s$, viscosity index of 143) and 50 mass % API Group 1 base oil (kinetic viscosity at 40° C. of 49.5 $mm^2/s$, viscosity index of 103).

Base Oil 2: A hydrocarbon base oil blend consisting of 40 mass % GTL (kinetic viscosity at 40° C. of 44.0 $mm^2/s$, viscosity index of 143) and 60 mass % API Group 1 base oil (kinetic viscosity at 40° C. of 49.5 $mm^2/s$, viscosity index of 103).

Base Oil 3: A hydrocarbon base oil blend consisting of 30 mass % GTL (kinetic viscosity at 40° C. of 44.0 $mm^2/s$, viscosity index of 143) and 70 mass % API Group 1 base oil (kinetic viscosity at 40° C. of 49.5 $mm^2/s$, viscosity index of 103).

Ultrabasic Mg salicylate: C9012 (from Infineum) (properties: base number of 336 mgKOH/g, Mg content of 7.2%)

Neutral Ba sulfonate: NaSuBSN (from King Industries) (properties: base number of 1 mg KOH/g or less, Ba content of 6.6%)

Ultrabasic Ba sulfonate: NaSuBSB (from King Industries) (properties: base number of 45 mgKOH/g, Ba content of 12.0%)

Neutral Na sulfonate: NaSuSS (from King Industries) (properties: base number of 1 mgKOH/g or less, Na content of 2.4%)

Neutral Zn sulfonate: NaSuZs (from King Industries) (properties: base number of 1 mgKOH/g or less, Zn content of 2.8%)

PMA1: non-dispersible polymethacrylate; Viscoplex 8-200 (from Evonik) (properties: polymer concentration of 72.5%, weight-average molecular weight of 33,000)

PMA2: non-dispersible polymethacrylate; Aclube V815 (from Sanyo Chemicals) (properties: polymer concentration of 60-70%, weight-average molecular weight of 20,000)

PMA3: non-dispersible polymethacrylate; Aclube 504 (from Sanyo Chemicals) (properties: polymer concentration of 35-45%, weight-average molecular weight of 180,000)

The weight-average molecular weight of PMA1 through PMA3 is measured under the following conditions. Measurement method: GPC (gel performance chromatography)

The weight-average molecular weight is calculated in accordance with JIS K7252-1 (Plastics—Determination of Average Molecular Mass and Molecular Mass Distribution of Polymers Using Size-Exclusion Chromatography—Part 1: General Principles).

Measuring device: SIL20AHT from Shimadzu

Columns used: Shodex LF604×2

Measurement temperature: 40° C.

The following examples and comparative examples were prepared.

Example 1

The lubricating oil composition in Example 1 was obtained by adding and thoroughly mixing 0.05 mass % of ultrabasic Mg salicylate and 0.20 mass % of PMA1 with 99.75 mass % of Base Oil 1.

Examples 2 to 13

The lubricating oil composition in Examples 2-13 were obtained in the same manner as Example 1 except that the compositions shown in Table 1 through Table 3 were used.

Comparative Examples 1-27

The lubricating oil composition in Examples 1-27 were obtained in the same manner as Example 1 except that the compositions shown in Table 4 through Table 8 were used.

Tests

The following tests were conducted where appropriate to determine the properties and performance of the examples and comparative examples.

Metal Content of Oil

The Mg, Ba, Na, and Zn content of the lubricating oil compositions were measured according to JPI Testing Standard JPI-5S-38-03 (Lubricating Oils—Determination of Additive Elements—Inductively Coupled Plasma Atomic Emission Spectrometry) of the Japan Petroleum Institute, and expressed in terms of ppm on a mass basis.

Viscosity: Kinetic Viscosity at 40° C.

The kinetic viscosity at 40° C. ($mm^2/s$) was measured in accordance with JIS K2283. Each of the examples and comparative examples was within the (46±10%) $mm^2/s$ range.

Polymer Content

The polymer content of the lubricating oil compositions due to the PMA was calculated and expressed in terms of the mass percentage.

Electrical Conductivity Test

The electrical conductivity was measured using the electrical conductivity test described in section 18 of JIS K2276 (Petroleum Products—Testing Methods for Aviation Fuels).

Because the measurement is affected by an unstable sample temperature, the samples were allowed to stand for twelve hours in a constant temperature chamber maintained at 25° C. and then tested using Electric Conductivity Meter Model 1152 from Emcee Electronics Inc. of the United States. The measurements were expressed in terms of siemens (S).

Evaluation Standards:

≥200 pS/m . . . Passed (o)

<200 pS/m . . . Did not pass (x)

Microclutch Test

In the microclutch test, the coefficient of friction at 140° C. was measured using the friction testing method for a microclutch tester described in JCMAS P047 (Hydraulic Fluids for Construction Machinery—Test Methods for Friction Characteristics) from the Japan Construction Mechanization Association.

Evaluation Standards:

Friction coefficient ≥0.08 . . . Passed (o)

Friction coefficient <0.08 . . . Did not pass (x)

Measurement of Flash Point

In the flash point measurement, a sample of each example and comparative example was measured three times using a Cleveland Flash & Fire Point Tester for the COC method in accordance with JIS K2265-4, and the average value was rounded off to one decimal place.

Evaluation Standards:

Flash point ≥240° C. . . . Passed (o)

Flash point <240° C. . . . Did not pass (x)

Measurement of Flow Point

The pour point was measured in accordance with JIS K2269.

Evaluation Standards:

Pour point ≤−40° C. . . . Passed (o)

Pour point >−40° C. . . . Did not pass (x)

Results

The results of each test are shown in Table 1 through Table 8.

Observations

In Examples 1-5, the base oil 1 contained ultrabasic Mg salicylate and PMA 1. As a result, they passed the electrical conductivity, microclutch friction coefficient, flash point, and pour point tests, and good results were obtained.

Example 2 contained ten times the PMA 1 of Example 1. As a result, the electrical conductivity was even better than that of Example 1. Example 3 contained two times the ultrabasic Mg salicylate of Example 1. As a result, the electrical conductivity was better than that of Example 1. Examples 4 and 5 contained five and ten times the PMA 1 of Example 3, and the electrical conductivity was further improved.

In Examples 6 and 7, the base oil 1 contained ultrabasic Mg salicylate and PMA 2. As a result, they passed the electrical conductivity, microclutch friction coefficient, flash point, and pour point tests, and good results were obtained. In Examples 6 and 7, the PMA used was different from that of Examples 3 and 4. However, Example 6 had good results similar to those of Example 3 and Example 7 had good results similar to those of Example 4. Examples 8 and 9 used PMA 3, but Example 8 had good results similar to those of Examples 3 and 6, which used different PMA, and Example 9 had good results similar to those of Examples 4 and 7.

Example 10 contained 2.4 times the ultrabasic Mg salicylate of Example 1, and the electrical conductivity was twice as good as that of Example 3.

Example 11 contained three times the ultrabasic Mg salicylate of Example 1, and the electrical conductivity was better than that of Examples 3 and 10. Example 12 contained three times the ultrabasic Mg salicylate of Example 2, and the electrical conductivity was better than that of Examples 2 and 5. Because Example 13 used base oil 2, the flash point was lower than that of base oil 1 in Example 4, but good electrical conductivity was obtained.

In contrast, because base oil 1 contains 0.10 mass % neutral Ba sulfonate, Comparative Example 1 had hardly any electrical conductivity at all and the pour point was higher. Even when 1.00 mass % PMA 1 was added to Comparative Example 1, the resulting Comparative Example 2 passed the pour point test but still had extremely low electrical conductivity. Microclutch measurement values are not recorded for Comparative Examples 1-20. This is because they did not pass the other tests so the measurement was omitted.

The amount of neutral Ba sulfonate was increased by 10% in Comparative Example 3 relative to Comparative Example 1 and in Comparative Example 4 relative to Comparative Example 2. However, the results remained unchanged. In Comparative Example 5, PMA 3 was used instead of the PMA 1 in Comparative Example 2. However, the results remained unchanged.

In Comparative Example 6, ultrabasic Ba sulfonate was added to base oil 1 but the electrical conductivity was low and the pour point was high. PMA 1 was added to Comparative Example 6 to obtain Comparative Example 7. It passed the pour point test but not the electrical conductivity test. More ultrabasic Ba sulfonate was added to Comparative Example 8 than to Comparative Example 6. The electrical conductivity improved somewhat but did not pass the test. It also did not pass the pour point test. More ultrabasic Ba sulfonate was added to Comparative Example 9 than to Comparative Example 7. The electrical conductivity improved somewhat but did not pass the test.

PMA 3 was added to Comparative Example 8 to obtain Comparative Example 10. However, it did not pass the pour point test and the electrical conductivity hardly changed at all.

In Comparative Example 11, 0.10 mass % neutral Na sulfonate was added to base oil 1. However, the electrical conductivity was poor and the pour point was high. Comparative Example 12 was obtained by adding 1.00 mass % PMA 1 to Comparative Example 11. However, it did not pass the pour point test and the electrical conductivity remained low. Three times the amount of neutral Na sulfonate was added to Comparative Example 13 relative to Comparative Example 11 and to Comparative Example 14 relative to Comparative Example 12. While the electrical conductivity numbers were better, they came close but still did not pass the test.

PMA 3 was added to Comparative Example 11 to obtain Comparative Example 15. While it passed the pour point test, the electrical conductivity hardly changed at all and good results were not obtained.

In Comparative Example 16, 0.10 mass % neutral Zn sulfonate was added to base oil 1. However, the electrical conductivity was poor and the pour point was high. Comparative Example 17 was obtained by adding 1.00 mass % PMA 1 to Comparative Example 16. While it passed the pour point test, the electrical conductivity was still low. Comparative Example 18 contains 2.6 times more neutral Zn sulfonate than Comparative Example 16, and Comparative Example 19 contained the same increase relative to Comparative Example 17. However, the pour point did not change. While the electrical conductivity numbers improved, they still did not pass the test.

PMA 3 was added to Comparative Example 16 to obtain Comparative Example 20. While it passed the pour point test, the electrical conductivity barely changed at all.

Comparative Example 21 was obtained by adding 0.05 mass % ultrabasic Ba sulfonate to base oil 1. While this passed the electrical conductivity test, the pour point was even higher. Comparative Example 22 contained two times more ultrabasic Ba sulfonate than Comparative Example 21. While the electrical conductivity improved, the pour point did not change and did not pass the test.

Comparative Example 23 contained 2.4 times more ultrabasic Ba sulfonate than Comparative Example 21. While the electrical conductivity improved further, the pour point did not change and was still undesirable.

Comparative Example 24 contained three times more ultrabasic Ba sulfonate than Comparative Example 21. While the electrical conductivity improved further, the pour point did not change and did not pass the test.

Base oil 1 in Comparative Example 22 was changed to base oil 2 to obtain Comparative Example 25. This passed the electrical conductivity test with about the same numerical value, but the pour point was even higher. Base oil 1 in Comparative Example 22 was changed to base oil 3 to obtain Comparative Example 26. The pour point was even higher and the flash point was lower. Neither test was passed. PMA 1 was added to Comparative Example 26 to obtain Comparative Example 27. While the pour point improved and the test was passed, the flash point remained low at an undesirable level.

TABLE 1

| | | Ex. 1 | Ex. 2 | Ex. 3 | Ex. 4 | Ex. 5 |
|---|---|---|---|---|---|---|
| Base Oil 1 | mass % | 99.75 | 97.95 | 99.70 | 98.90 | 97.90 |
| Base Oil 2 | mass % | | | | | |
| Base Oil 3 | mass % | | | | | |
| Ultrabasic Mg salicylate | mass % | 0.05 | 0.05 | 0.10 | 0.10 | 0.10 |
| Neutral Ba sulfonate | mass % | | | | | |
| Ultrabasic Ba sulfonate | mass % | | | | | |
| Neutral Na sulfonate | mass % | | | | | |

TABLE 1-continued

| | | Ex. 1 | Ex. 2 | Ex. 3 | Ex. 4 | Ex. 5 |
|---|---|---|---|---|---|---|
| Neutral Zn sulfonate | mass % | | | | | |
| PMA 1 | mass % | 0.20 | 2.00 | 0.20 | 1.00 | 2.00 |
| PMA 2 | mass % | | | | | |
| PMA 3 | mass % | | | | | |
| Elemental Mg content | mass ppm | 55 | 55 | 80 | 80 | 80 |
| Elemental Ba content | mass ppm | | | | | |
| Elemental Na content | mass ppm | | | | | |
| Elemental Zn content | mass ppm | | | | | |
| KV (40° C.) | $mm^2/s$ | 46.4 | 50.3 | 46.4 | 48.2 | 50.3 |
| Net polymer amount | mass % | 0.145 | 1.45 | 0.145 | 0.725 | 1.45 |
| Electric conductivity (25° C.) (pS) | pS | 250 | 318 | 410 | 530 | 680 |
| Microclutch (140° C.) | | 0.164 | 0.164 | 0.140 | 0.140 | 0.140 |
| Flash point | ° C. | 264 | 264 | 264 | 264 | 264 |
| Pour point | ° C. | −40.0 | −40.0 | −40.0 | −42.5 | −42.5 |

TABLE 2

| | | Ex. 6 | Ex. 7 | Ex. 8 | Ex. 9 |
|---|---|---|---|---|---|
| Base Oil 1 | mass % | 99.70 | 98.90 | 99.70 | 98.90 |
| Base Oil 2 | mass % | | | | |
| Base Oil 3 | mass % | | | | |
| Ultrabasic Mg salicylate | mass % | 0.10 | 0.10 | 0.10 | 0.10 |
| Neutral Ba sulfonate | mass % | | | | |
| Ultrabasic Ba sulfonate | mass % | | | | |
| Neutral Na sulfonate | mass % | | | | |
| Neutral Zn sulfonate | mass % | | | | |
| PMA 1 | mass % | | | | |
| PMA 2 | mass % | 0.20 | 1.00 | | |
| PMA 3 | mass % | | | 0.20 | 1.00 |
| Elemental Mg content | mass ppm | 80 | 80 | 80 | 80 |
| Elemental Ba content | mass ppm | | | | |
| Elemental Na content | mass ppm | | | | |
| Elemental Zn content | mass ppm | | | | |
| KV (40° C.) | $mm^2/s$ | 46.1 | 46.9 | 46.3 | 47.2 |
| Net polymer amount | mass % | 0.12-0.14 | 0.6-0.7 | 0.07-0.09 | 0.35-0.45 |
| Electric conductivity (25° C.) | pS | 400 | 520 | 415 | 530 |
| Microclutch (140° C.) | | 0.140 | 0.140 | 0.140 | 0.140 |
| Flash point | ° C. | 264 | 264 | 264 | 264 |
| Pour point | ° C. | −40.0 | −42.5 | −40.0 | −42.5 |

TABLE 3

| | | Ex. 10 | Ex. 11 | Ex. 12 | Ex. 13 |
|---|---|---|---|---|---|
| Base Oil 1 | mass % | 99.69 | 99.65 | 97.85 | |
| Base Oil 2 | mass % | | | | 98.90 |
| Base Oil 3 | mass % | | | | |
| Ultrabasic Mg salicylate | mass % | 0.12 | 0.15 | 0.15 | 0.10 |

TABLE 3-continued

| | | Ex. 10 | Ex. 11 | Ex. 12 | Ex. 13 |
|---|---|---|---|---|---|
| Neutral Ba sulfonate | mass % | | | | |
| Ultrabasic Ba sulfonate | mass % | | | | |
| Neutral Na sulfonate | mass % | | | | |
| Neutral Zn sulfonate | mass % | | | | |
| PMA 1 | mass % | 0.20 | 0.20 | 2.00 | 1.00 |
| PMA 2 | mass % | | | | |
| PMA 3 | mass % | | | | |
| Elemental Mg content | mass ppm | 90 | 120 | 120 | 80 |
| Elemental Ba content | mass ppm | | | | |
| Elemental Na content | mass ppm | | | | |
| Elemental Zn content | mass ppm | | | | |
| Kinetic viscosity (40° C.) | $mm^2/s$ | 46.0 | 46.4 | 50.3 | 48.2 |
| Net polymer amount | mass % | 0.145 | 0.145 | 1.45 | 0.725 |
| Electric conductivity (25° C.) | pS | 568 | 600 | 717 | 625 |
| Microclutch (140° C.) | | 0.131 | 0.117 | 0.117 | 0.140 |
| Flash point | ° C. | 264 | 264 | 264 | 250 |
| Pour point | ° C. | −40.0 | −40.0 | −42.5 | −42.5 |

TABLE 4

| | | C. Ex. 1 | C. Ex. 2 | C. Ex. 3 | C. Ex. 4 | C. Ex. 5 |
|---|---|---|---|---|---|---|
| Base Oil 1 | mass % | 99.90 | 98.90 | 99.89 | 98.89 | 98.90 |
| Base Oil 2 | mass % | | | | | |
| Base Oil 3 | mass % | | | | | |
| Ultrabasic Mg salicylate | mass % | | | | | |
| Neutral Ba sulfonate | mass % | 0.10 | 0.10 | 0.11 | 0.11 | 0.10 |
| Ultrabasic Ba sulfonate | mass % | | | | | |
| Neutral Na sulfonate | mass % | | | | | |
| Neutral Zn sulfonate | mass % | | | | | |
| PMA 1 | mass % | | 1.00 | | 1.00 | |
| PMA 2 | mass % | | | | | |
| PMA 3 | mass % | | | | | 1.00 |
| Elemental Mg content | mass ppm | | | | | |
| Elemental Ba content | mass ppm | 60 | 60 | 65 | 65 | 60 |
| Elemental Na content | mass ppm | | | | | |
| Elemental Zn content | mass ppm | | | | | |
| KV (40° C.) ($mm^2/s$) | $mm^2/s$ | | 48.2 | | 48.2 | 47.2 |
| Net polymer amount | mass % | | 0.725 | | 0.725 | 0.35-0.45 |
| Electric conductivity (25° C.) | pS | 8 | 10 | 9 | 12 | 9 |

TABLE 4-continued

| | | C. Ex. 1 | C. Ex. 2 | C. Ex. 3 | C. Ex. 4 | C. Ex. 5 |
|---|---|---|---|---|---|---|
| Microclutch (140° C.) | | — | — | — | — | — |
| Flash point | ° C. | 264 | 264 | 264 | 264 | 264 |
| Pour point | ° C. | −17.5 | −42.5 | −17.5 | −42.5 | −42.5 |

TABLE 5

| | | C. Ex. 6 | C. Ex. 7 | C. Ex. 8 | C. Ex. 9 | C. Ex. 10 |
|---|---|---|---|---|---|---|
| Base Oil 1 | mass % | 99.64 | 98.94 | 99.90 | 98.90 | 98.90 |
| Base Oil 2 | mass % | | | | | |
| Base Oil 3 | mass % | | | | | |
| Ultrabasic Mg salicylate | mass % | | | | | |
| Neutral Ba sulfonate | mass % | | | | | |
| Ultrabasic Ba sulfonate | mass % | 0.06 | 0.06 | 0.10 | 0.10 | 0.10 |
| Neutral Na sulfonate | mass % | | | | | |
| Neutral Zn sulfonate | mass % | | | | | |
| PMA 1 | mass % | | 1.00 | | 1.00 | |
| PMA 2 | mass % | | | | | |
| PMA 3 | mass % | | | | | 1.00 |
| Elemental Mg content | mass ppm | | | | | |
| Elemental Ba content | mass ppm | 65 | 65 | 110 | 110 | 110 |
| Elemental Na content | mass ppm | | | | | |
| Elemental Zn content | mass ppm | | | | | |
| KV (40° C.) | $mm^2/s$ | | 48.2 | | 48.2 | 47.2 |
| Net polymer amount | mass % | | 0.725 | | 0.725 | 0.35-0.45 |
| Electric conductivity (25° C.) | pS | 24 | 29 | 41 | 50 | 46 |
| Microclutch (140° C.) | | — | — | — | — | — |
| Flash point | ° C. | 264 | 264 | 264 | 264 | 264 |
| Pour point | ° C. | −17.5 | −42.5 | −17.5 | −42.5 | −42.5 |

TABLE 6

| | | C. Ex. 11 | C. Ex. 12 | C. Ex. 13 | C. Ex. 14 | C. Ex. 15 |
|---|---|---|---|---|---|---|
| Base Oil 1 | mass % | 99.90 | 98.90 | 99.70 | 98.70 | 98.90 |
| Base Oil 2 | mass % | | | | | |
| Base Oil 3 | mass % | | | | | |
| Ultrabasic Mg salicylate | mass % | | | | | |
| Neutral Ba sulfonate | mass % | | | | | |
| Ultrabasic Ba sulfonate | mass % | | | | | |
| Neutral Na sulfonate | mass % | 0.10 | 0.10 | 0.30 | 0.30 | 0.10 |
| Neutral Zn sulfonate | mass % | | | | | |
| PMA 1 | mass % | | 1.00 | | 1.00 | |
| PMA 2 | mass % | | | | | |
| PMA 3 | mass % | | | | | 1.00 |
| Elemental Mg content | mass ppm | | | | | |
| Elemental Ba content | mass ppm | | | | | |
| Elemental Na content | mass ppm | 15 | 15 | 45 | 45 | 15 |
| Elemental Zn content | mass ppm | | | | | |
| KV (40° C.) | $mm^2/s$ | | 48.2 | | 48.2 | 47.2 |
| Net polymer amount | mass % | | 0.725 | | 0.725 | 0.35-0.45 |
| Electric conductivity (25° C.) | pS | 14 | 16 | 42 | 50 | 15 |
| Microclutch (140° C.) | | — | — | — | — | — |
| Flash point | ° C. | 264 | 264 | 264 | 264 | 264 |
| Pour point | ° C. | −17.5 | −42.5 | −17.5 | −42.5 | −42.5 |

TABLE 7

| | | C. Ex. 16 | C. Ex. 17 | C. Ex. 18 | C. Ex. 19 | C. Ex. 20 |
|---|---|---|---|---|---|---|
| Base Oil 1 | mass % | 99.90 | 98.90 | 99.74 | 98.74 | 98.90 |
| Base Oil 2 | mass % | | | | | |
| Base Oil 3 | mass % | | | | | |
| Ultrabasic Mg salicylate | mass % | | | | | |
| Neutral Ba sulfonate | mass % | | | | | |
| Ultrabasic Ba sulfonate | mass % | | | | | |
| Neutral Na sulfonate | mass % | | | | | |
| Neutral Zn sulfonate | mass % | 0.10 | 0.10 | 0.26 | 0.26 | 0.10 |
| PMA 1 | mass % | | 1.00 | | 1.00 | |
| PMA 2 | mass % | | | | | |
| PMA 3 | mass % | | | | | 1.00 |
| Elemental Mg content | mass ppm | | | | | |
| Elemental Ba content | mass ppm | | | | | |
| Elemental Na content | mass ppm | | | | | |
| Elemental Zn content | mass ppm | 20 | 20 | 52 | 52 | 20 |
| KV (40° C.) | $mm^2/s$ | | 48.2 | | 48.2 | 47.2 |
| Net polymer amount | mass % | | 0.725 | | 0.725 | 0.35-0.45 |
| Electric conductivity (25° C.) | pS | 8 | 10 | 21 | 20 | 9 |
| Microclutch (140° C.) | | — | — | — | — | — |
| Flash point | ° C. | 264 | 264 | 264 | 264 | 264 |
| Pour point | ° C. | −17.5 | −42.5 | −17.5 | −42.5 | −42.5 |

TABLE 8

| | | C. Ex. 21 | C. Ex. 22 | C. Ex. 23 | C. Ex. 24 | C. Ex. 25 | C. Ex. 26 | C. Ex. 27 |
|---|---|---|---|---|---|---|---|---|
| Base Oil 1 | mass % | 99.95 | 99.90 | 99.89 | 99.85 | | | |
| Base Oil 2 | mass % | | | | | 99.90 | | |
| Base Oil 3 | mass % | | | | | | 99.90 | 98.90 |
| Ultra-basic Mg salicylate | mass % | 0.05 | 0.10 | 0.12 | 0.15 | 0.10 | 0.10 | 0.10 |
| Neutral Ba sulfonate | mass % | | | | | | | |
| Ultra-basic Ba sulfonate | mass % | | | | | | | |
| Neutral Na sulfonate | mass % | | | | | | | |
| Neutral Zn sulfonate | mass % | | | | | | | |
| PMA 1 | mass % | | | | | | | 1.00 |
| PMA 2 | mass % | | | | | | | |
| PMA 3 | mass % | | | | | | | |
| Elemental Mg content | mass ppm | 55 | 80 | 90 | 120 | 80 | 80 | 80 |
| Elemental Ba content | mass ppm | | | | | | | |
| Elemental Na content | mass ppm | | | | | | | |
| Elemental Zn content | mass ppm | | | | | | | |
| KV (40° C.) | $mm^2/s$ | | | | | | | 47.2 |
| Net polymer amount | mass % | | | | | | | 0.725 |
| Electric conductivity (25° C.)) | pS | 238 | 380 | 461 | 575 | 356 | 414 | 490 |
| Micro-clutch (140° C.) | | 0.164 | 0.14 | 0.131 | 0.117 | 0.14 | 0.14 | 0.14 |
| Flash point | ° C. | 264 | 264 | 264 | 264 | 250 | 238 | 238 |
| Pour point | ° C. | −17.5 | −17.5 | −17.5 | −17.5 | −15.0 | −12.5 | −42.5 |

That which is claimed is:

1. A lubricating oil composition for hydraulic machinery equipped with an electronic control device, the lubricating oil composition comprising a hydrocarbon base oil, from 30 to 250 ppm of ultrabasic magnesium salicylate in terms of magnesium content relative to the total amount of the composition, and from 0.07 to 5.0 mass % of non-dispersible polymethacrylate having a weight-average molecular weight of from 5,000 to 200,000 as a net amount relative to the total amount of the composition, the electric conductivity of the composition at 25° C. being 200 pS/m or more, the flash point being 240° C. or more, the pour point being −40° C. or less, and the coefficient of friction at 140° C. (microclutch test) being 0.08 or more.

2. The lubricating oil composition for hydraulic machinery equipped with an electronic control device according to claim 1, wherein the hydrocarbon base oil comprises a gas-to-liquid (GTL) base oil.

3. The lubricating oil composition for hydraulic machinery equipped with an electronic control device according to claim 2, wherein the hydrocarbon base oil comprises at least 40 mass % of a gas-to-liquid (GTL) base oil.

4. The lubricating oil composition for hydraulic machinery equipped with an electronic control device according to claim 1, wherein the viscosity grade of the composition is VG 46 to 68.

* * * * *